United States Patent [19]

Ellis

[11] 4,166,462

[45] Sep. 4, 1979

[54] SELF-PROPELLED SHARK-PROOF CAGE

[76] Inventor: James M. Ellis, New West Rd., Port Lincoln, Australia, 5606

[21] Appl. No.: 711,815

[22] Filed: Aug. 5, 1976

[30] Foreign Application Priority Data

Sep. 4, 1975 [AU] Australia ..... PC3048

[51] Int. Cl.[2] ..... B63C 11/42

[52] U.S. Cl. ..... 128/145 R; 128/142.3; 405/185; 114/315; 114/338; 9/313; 114/333

[58] Field of Search ..... 128/142 R, 142.2, 142.3, 128/142.4, 142.5, 147; 9/14 R, 8 R, 313; 61/69 R, 69 A; 114/16 R, 16 A, 16 E, 121

[56] References Cited

U.S. PATENT DOCUMENTS

| | | | |
|---|---|---|---|
| 3,176,327 | 4/1965 | Oberth | 9/14 R |
| 3,190,256 | 6/1965 | Buie | 61/69 R |
| 3,425,231 | 2/1969 | Rehrer | 114/16 E |
| 3,688,720 | 9/1972 | Lok | 114/16 E |
| 3,795,213 | 3/1974 | Strickland | 114/16 A |

OTHER PUBLICATIONS

"The Advertiser", Diver's Cage Could Beat Shark Menace, published in Adelaide, Australia, Apr. 30, 1975.

"Port Lincoln Times", Shark-Proof Diver's Vehicle is Tested, May 1, 1975.

*Primary Examiner*—Henry J. Recla

*Attorney, Agent, or Firm*—Norbert P. Holler

[57] ABSTRACT

The invention relates to a self-propelled shark-proof cage which is provided with at least one access opening and a propeller mounting frame having pivot means coupling it to the cage so that the propeller mounting frame is pivotal about two axes at right angles to each other, and the propeller mounting frame carries on it an air motor and a propeller. The frame is provided with buoyancy means so that it can be made to be of approximately the same gravity as sea-water, and the air motor is driven by compressed air so that the cage can be propelled through the water, thereby enabling abalone divers to collect abalone without fear of predators and, beacause of less exertion, for longer periods of time.

12 Claims, 3 Drawing Figures

SELF-PROPELLED SHARK-PROOF CAGE

This invention relates to a self-propelled shark-proof cage which is particularly useful for abalone divers.

BACKGROUND OF THE INVENTION

In many parts of the world there is much fear among divers of attack by predators. The white-pointer shark in some waters has been known to take lives, and attacks have also been made by other species of shark including tiger sharks, the whaler species and mako sharks. Much valuable diving time is lost due to the prevalence of predators, and particularly due to risk of attack in turbid water and it is therefore desirable that the divers should have some means of protecting them against attack. A diver is considered most vulnerable to shark attack when at the surface.

Divers are also subject to "bends", a sickness which is caused by rapid decompression and excessive exertion. There is also a need to provide means whereby a diver can travel beneath the surface of the water for extended periods of time without the exertion required by swimming. Another factor which reduces the incidence of bends is the temperature and fatigue to which the diver is subject.

When abalone are gathered by normal means, bags are filled and brought to the surface by the diver. However it is desirable that the abalone diver should be able to remain beneath the surface for extended periods, and be able to send bags of abalone to the surface as soon as they are filled, thereby increasing the catch possible in a given period of time.

BRIEF SUMMARY OF THE INVENTION

With the object of providing a self-propelled cage which is substantially shark-proof in this invention a cage is provided with a propeller mounting frame which is pivotal with respect to the cage so that it may be moved about two axes at right angles to each other, the propeller mounting frame having an air motor driving a propeller so that the cage can be thereby propelled through the water. The frame is also provided with buoyancy means so that its density does not greatly differ from that of sea water. Air lines are coupled to the air motor and are provided with coupling means so that they can be also coupled to the output of an air compressor for effecting the propulsion of the cage beneath the water.

Thus according to one aspect of the invention a self-propelled shark-proof cage comprises a frame, cage walls carried by the frame, at least one access opening in at least one of the cage walls, a propeller mounting frame, pivot means coupling the propeller mounting frame to the cage so arranged that the propeller mounting frame is pivotal about axes which are at right angles to each other, an air motor and a propeller carried by the propeller mounting frame, drive means coupling the propeller to the air motor for drive, buoyancy means on the frame, and an air line coupled to the air motor and having coupling means thereon for coupling to the output of the air compressor.

In one aspect of the invention some of the cage walls comprise mesh, while in another aspect of the invention some comprise bars. In a still further aspect, the propeller mounting frame is pivoted by a first pair of aligned pivots, constituting a part of the said pivot means, to a ring of a gimbal, at one end of the cage frame, and the pivot means further comprises a second pair of aligned pivots between the gimbal ring and the cage frame, the pivot axis of the second pair of pivots being at right angles to that of the first pair. In a still further aspect the propeller mounting frame is provided with a control arm extending inwardly into the cage from the propeller mounting frame, and having an air throttle on the control arm, the air throttle being in the air motor air line. It is preferred that the air motor is always pressurised by air at a pressure exceeding the working depth pressure and thereby resists entry of water. This can be achieved for example by having the throttle valve on the discharge side of the motor, or by having a spring loaded exhaust valve. In a still further aspect, the buoyancy means comprises buoyancy chambers which are also coupled to the air line.

BRIEF DESCRIPTION OF THE DRAWINGS

An embodiment of the invention is described hereunder in some detail with reference to and is illustrated in the accompanying drawings in which.

Figure 1:
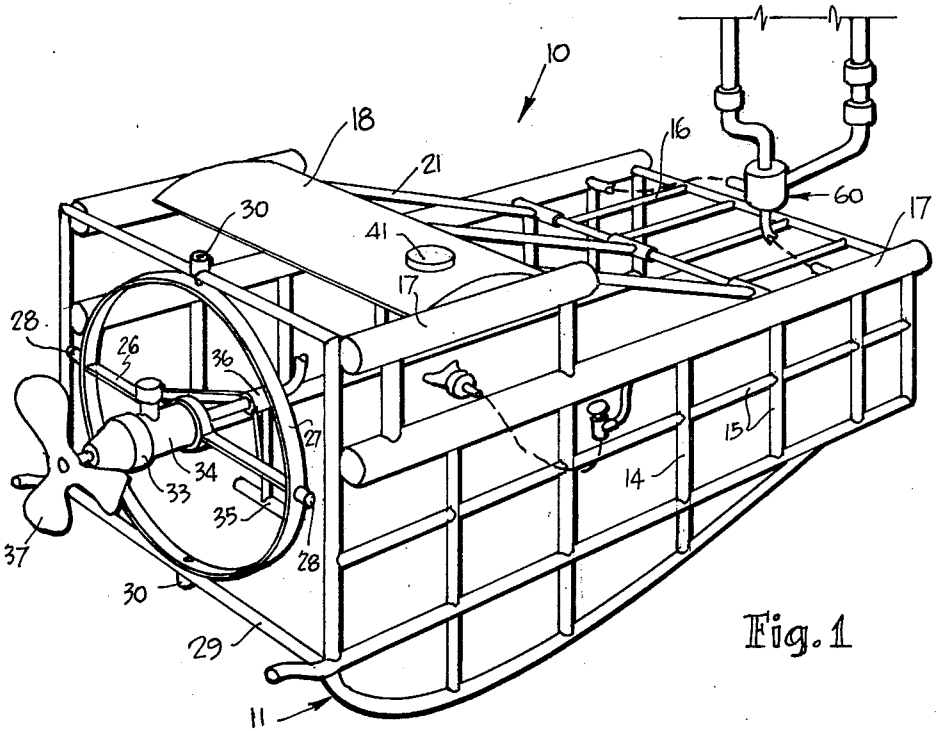
FIG. 1 is a perspective view of a self-propelled shark-proof cage.

In this embodiment a self-propelled shark-proof cage 10 comprises a frame 11, cage walls which include rear end wall 12, side walls 14 having bars 15 therein, and an upper wall 16 which in this embodiment is flanked by aluminum tubes 17 and an air buoyancy control tank 18 which is described hereunder in further detail.

Figure 2:
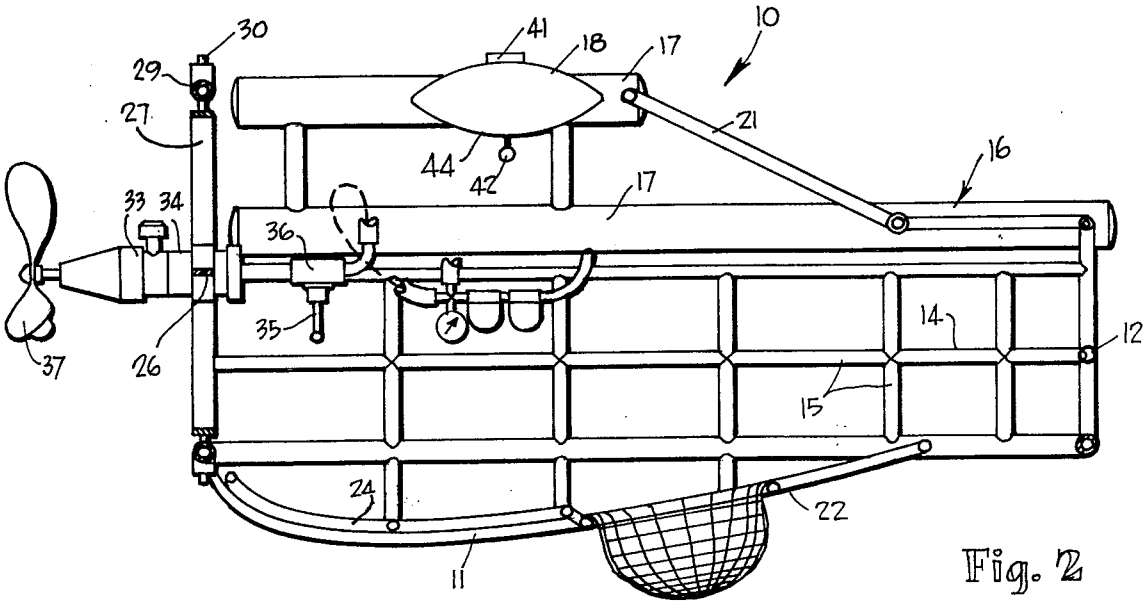
FIG. 2 is a longitudinal section through FIG. 1.

The upper wall 16 is provided with a hinged grating type hatch designated 21 and this is hinged so as to normally lie in its closed position as illustrated best in FIG. 2 under the effects of gravity but being movable to allow egress of a diver. The lower wall which is herein designated 22 may also be provided with a hatch designated 24 hinged thereto which allows egress of a diver but also provides means whereby a diver can reach down from the cage for abalone. In many applications the hatch 24 is not necessary.

A propeller mounting frame is mounted in the cage by means of a gimbal arrangement. In the illustrated embodiment, the propeller mounting frame is arranged within the ring 27. The gimbal is provided with a pair of coaxial pivots 28 which pivotally support the propeller mounting frame 26 within the ring 27, and a further pair of aligned coaxial pivots 30 pivotally mount the gimbal ring 27 to the front end 29 of the cage frame 11, the pivot axis of the pivots 30 being at right angles to that of the pivots 28.

The propeller mounting frame 26 supports a propeller assembly comprising a gear-box 33 driven by an air motor 34, the two being controlled by a control arm 35 having a "twist grip" throttle valve 36 thereon for controlling speed of the air motor 34. Thus with one hand an abalone diver when in the cage can control the direction of propulsion of the propeller 37 driven by the air motor 34 through gear-box 33, enabling the cage to be moved through the water (in this embodiment between 2 and 3 knots) but if necessary enabling the cage to be made to hover within the water while abalone are being collected, since the torgue of the propeller tends to direct it upwardly.

Figure 3:
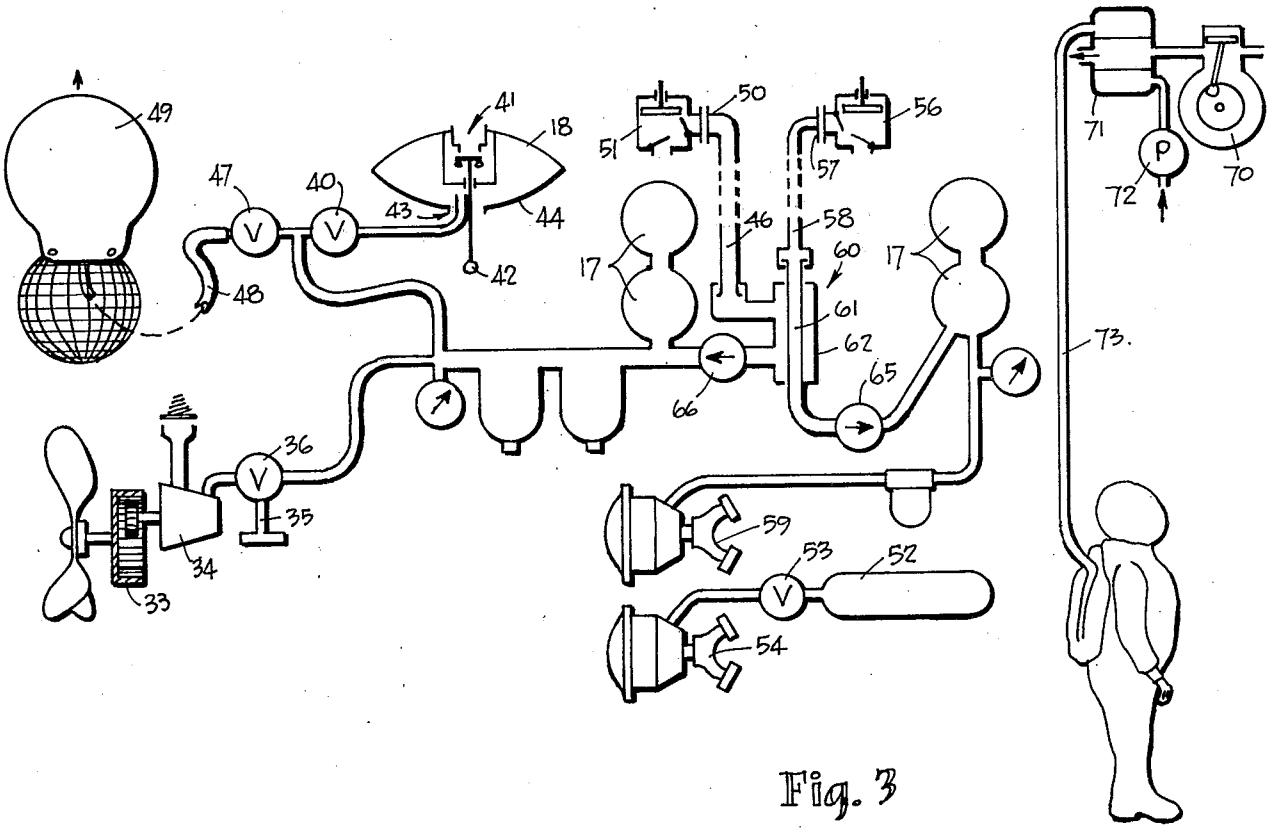
FIG. 3 is a diagrammatic representation of the pneumatic arrangement.

As shown best in FIG. 1, the cage 10 comprises four aluminium tubes 17, and as shown in FIG. 3 the aluminium tubes 17 are pressurised with air to prevent collapse of the tubes, provide buoyancy for the cage and air reserves. The volume of the tubes is carefully arranged so that when the tubes are the only elements of the cage which are buoyant, the cage has a higher density than sea water and will sink. However it is desirable for a diver to be able to control the buoyancy, and this is achieved by having the buoyancy control air tank designated 18 which, as shown in FIGS. 2 and 3, is of hydrofoil shape. The air tank 18 is provided with an air inlet valve 40, and an air release valve 41 which is operated by means of a pull cord 42, the tank 18 being open downwardly by means of an opening designated 43 which is in the lower wall 44 of the tank 18. If there should be any malfunction of the valve 41, it can be operated manually from above the tank.

The air line for the air motor is designated 46, and this also feeds the aluminium tubes 17 on one side of the cage, and the tank 18 as illustrated in FIG. 3. It is also provided with a valve 47 and an inflating tube 48, the valve 47 when opened allowing air to pass outwardly through the tube 48. This enables an abalone diver to inflate a buoyancy bladder 49 which is attached to a bag full of abalone and thereby send it to the surface quickly and efficiently. The neck of the buoyancy bladder should be of similar diameter to inflating tube 48, so as to prevent air from spilling when it reaches the surface.

The air line 46 has its upper end a coupling designated 50 by which it is coupled to an engine driven air compressor 51 which operates continuously.

An abalone diver while using the shark-proof cage 10 is provided with emergency SCUBA gear, consisting of an air tank 52 which feeds through a valve 53 into a mouth piece 54. However this is emergency equipment only, and normally the diver accepts air from a small compressor designated 56 in FIG. 3 which is coupled through a coupling 57 to an air line 58, the air line 58 leading down to a second mouth piece 59 which is normally used by the abalone diver. This air line 58 provides air for the other aluminium tubes 17 (on the port side of the cage).

Since the cage may be propelled through the water in various directions, it is desirable that means be provided to prevent the air lines 46 and 58 tangling and this is achieved by means of a double concentric swivel generally designated 60, the swivel 60 having a concentric inner tube 61 and a concentric outer tube 62 respectively coupled to the air lines 58 and 46 so that swivelling of both air lines can take place independently. By use of a separate compressor 56, the relatively small amount of air required by a diver can be supplied in very clean and pure form, but the expense of supplying large quantities of air in clean and pure form is reduced by utilising the second larger air compressor 51.

Although the equipment is so designed that damage to air lines 46 and 58 is unlikely to occur, each air line contains a non-return valve, respectively designated 65 and 66. It should be noted that the port side tubes 17 provide a small reservoir of breathable air which can be made use of in the case of malfunction, while the air bag inflating hose 48 enables a diver to also breathe from the starboard side tubes 17.

A consideration of the above embodiment will indicate that the invention is quite simple, but it has been found to be exceedingly effective in increasing productivity of abalone divers. With various modifications, it may also be used for other purposes. It has been found that utilising an air motor of 2.0 horse power and geared from 15,000 rpm to 800 rpm through a planetary gear box 33, the vessel is capable of moving through the water at 2 to 3 knots. Since the air motor is normally pressurized, ingress of water is avoided. Preferably the two air lines 46 and 58 and heating hose 73 are bound together for their length to resist the tendency to twist and tangle. The device may be also provided with a power head for protection against shark attack, depth gauges and decompression meters. Since physical effort is greatly reduced, and the facility to enable a diver to stay beneath the surface is increased, the incidence of bends can be reduced by this invention.

One of the factors which limits the time of immersion of a diver is the cold conditions under which he works. The compressors 51 and 56 are driven by an engine 70 (FIG. 3) which heats an exchanger 71, this is turn heats water driven by pump 72 and carried to the diver through hose 73 to be released into the space which exists between his body and wet suit.

The temperature can be varied by regulating the pressure of water driven by pump 72. This is accomplished by regulating a bypass valve on the pump outlet.

I claim:

1. A self-propelled shark-proof cage comprising:

an elongated frame, and wall means mounted on said frame for preventing sharks from entering the cage, said wall means including an upper wall and a base wall, a first access opening in said upper wall and a second access opening in said base wall, and a hatch door hinged to said upper wall and adapted to releasably overlie said first access opening and, when closed, to be retained in that state by the effects of gravity, a propeller mounting frame mounted on one end of said cage frame, pivot means coupling said propeller mounting frame to said cage frame for pivotal movement of said propeller mounting frame about two axes at right angles to each other, an air motor and a propeller mounted on said propeller mounting frame, and transmission means drivingly coupling said air motor to said propeller, buoyancy means mounted on said cage frame, said buoyancy means comprising a buoyancy control air tank secured to said upper wall and extending transversely to the opposite sides of said cage frame, and an air line coupled to said air motor and having coupling means thereon enabling connection of said air motor air line to the output of an air compressor.

2. A self-propelled shark-proof cage according to claim 1 wherein some at least of said cage frame walls comprise mesh.

3. A self-propelled shark-proof cage according to claim 1 wherein some at least of said cage frame walls comprise bars.

4. A self-propelled shark-proof cage according to claim 1 wherein said pivot means comprise a first pair of aligned pivots coupling said propeller mounting frame to a gimbal ring, and a second pair of aligned pivots having their pivot axis at right angles to that of said first pair of pivots and coupling said gimbal ring to said cage frame.

5. A self-propelled shark-proof cage according to claim 1 further comprising a control arm secured to said propeller mounting frame and extending inwardly into the cage therefrom, and an air throttle mounted on said control arm, said air throttle being connected in said air motor air line.

6. A self-propelled shark-proof cage according to claim 1 wherein said buoyancy means comprises buoyancy chambers, and means coupling said air motor air line to said buoyancy chambers.

7. A self-propelled shark-proof cage according to claim 6 wherein said buoyancy chambers include an air buoyancy tank having a downwardly facing opening in a wall thereof, said tank containing a valve connected to said air motor air line and operable to introduce air therefrom into said, tank.

8. A self-propelled shark-proof cage according to claim 1 further comprising a breathing air line, a mouth piece on one end of said breathing air line, and coupling means on the other end of the breathing air line and adapted to couple the latter to the output of an air compressor.

9. A self-propelled shark-proof cage according to claim 8 further comprising two air compressors, and engine means connected to said air compressors for the driving thereof, said air motor air line being coupled by its coupling means to one of said compressors, and said breathing air line being coupled by its coupling means to the other of said air compressors.

10. A self-propelled shark-proof cage according to claim 8 further comprising a pneumatic swivel having two concentric tubular portions, one of said portions being connected in said air motor air line, and the other of said portions being connected in said breathing air line.

11. A self-propelled shark-proof cage comprising:

an elongated frame, and wall means mounted on said frame for preventing sharks from entering the cage, said wall means including an upper wall and a base wall, a first access opening in said upper wall and a second access opening in said base wall, and a hatch door hinged to said upper wall and adapted to releasably overlie said first access opening and, when closed, to be retained in that state by the effects of gravity, a propeller mounting frame mounted on one end of said cage frame, pivot means coupling said propeller mounting frame to said cage frame for pivotal movement of said propeller mounting frame about two axes at right angles to each other, a motor and a propeller mounted on said propeller mounting frame, and transmission means drivingly coupling said motor to said propeller, and buoyancy means mounted on said cage frame, said buoyancy means comprising a buoyancy control air tank secured to said upper wall and extending transversely to the opposite sides of said cage frame.

12. A self-propelled shark-proof cage according to claim 11, wherein said buoyancy control air tank is of generally hydrofoil shape and has a top wall and a bottom wall and an opening in said bottom wall, and the cage further comprises an air line conduit having one end extending into said opening in said bottom wall of said buoyancy control air tank and having another end adapted for connection to an air compressor, for establishing communication between said air compressor and the interior of said buoyancy control air tank, an air inlet valve controlling said air line conduit and operable, when opened, to permit introduction of compressed air into said buoyancy control air tank, and an air release valve in said top wall of said buoyancy control air tank and operable, when opened, to release air from the top of the latter.

* * * * *